United States Patent [19]

Finnegan et al.

[11] Patent Number: 4,951,025

[45] Date of Patent: Aug. 21, 1990

[54] THERMALLY MONITORED ELECTRICAL OUTLET RECEPTACLE RECEPTACLE APPARATUS

[75] Inventors: Francis Finnegan, Attleboro, Mass.; Anthony Azzara, Greenville, R.I.

[73] Assignee: Texas Instruments Incorporated, Dallas, Tex.

[21] Appl. No.: 372,397

[22] Filed: Jun. 23, 1989

[51] Int. Cl.[5] ..... H01H 37/04

[52] U.S. Cl. ..... 337/113; 337/187; 337/381

[58] Field of Search ..... 337/113, 91, 112, 380, 337/381, 187, 3; 439/620, 621, 622

[56] References Cited

U.S. PATENT DOCUMENTS

| | | | |
|---|---|---|---|
| 3,546,650 | 12/1970 | Purer | 337/113 |
| 4,538,134 | 8/1975 | Carey | 337/113 |
| 4,570,145 | 2/1986 | Carey | 337/113 |

*Primary Examiner*—H. Broome

*Attorney, Agent, or Firm*—John A. Haug; James P. McAndrews; Melvin Sharp

[57] ABSTRACT

An electrical outlet receptacle is shown having a thermally responsive switch disposed within the receptacle thermally coupled to components of the receptacle and adapted to interrupt power thereto upon the occurrence of overload or overtemperature conditions in the environs of the receptacle.

32 Claims, 4 Drawing Sheets

THERMALLY MONITORED ELECTRICAL OUTLET RECEPTACLE RECEPTACLE APPARATUS

BACKGROUND OF THE INVENTION

This invention relates generally to electrical outlet receptacles and more specifically to thermally monitored and protected receptacles.

DESCRIPTION OF THE PRIOR ART

Although receptacles made in accordance with appropriate agency code requirements, such as those of Underwriters Laboratory, are not fire hazards in and of themselves it is nevertheless the case that many fires are started at the locus of the receptacle. Situations which can result in fire hazards include loose connections between the receptacle and leads connected thereto, defective plugs or cords, short circuits as well as overloads.

In addition to fuse or circuit breaker protection responsive to overloads on circuits there have been attempts in the prior art to provide overload and short circuit protection at the receptacle itself. For example U.S. Pat. Nos. 3,169,239; 3,913,046; 4,091,352; and 4,514,715 all show switches responsive to abnormal current in a receptacle which are adapted to interrupt the current supply to the receptacle. No matter how effective these approaches may be it is apparent that they do not provide complete protection against all of the hazards listed above.

SUMMARY OF THE INVENTION

An object of the present invention is to provide thermal protection for electrical outlet receptacles. Another object is the provision of protection from both over current and overtemperature conditions existing at the locus of an electrical outlet receptacle. Yet another object of the invention is to provide thermal monitoring of an electrical outlet receptacle and to protect electrical outlet receptacle structure and surrounding material from damage caused by excessive temperature conditions. Another object is the provision of thermal protection for electrical outlet receptacle which is easily manufactured and installed, rugged enough to withstand automated handling and assembly and inexpensive to produce. Other objects and advantages of the present invention will be more fully apparent from the following description of the preferred embodiments when taken in conjunction with the accompanying drawings.

Briefly described, the invention comprises a thermally responsive switch disposed in a cavity formed in a receptacle housing thermally coupled to the components of the receptacle including the two spaced electrical rail means adapted to engage the male prongs of a plug received in the receptacle.

In one embodiment of the invention the switch is disposed in an electrically insulative sleeve which is mounted intermediate the two spaced rail means and in physical engagement therewith. According to another embodiment the switch is mounted in direct physical engagement with one of the rails. According to a feature of the invention the switch is adapted to interrupt power to one or both rails and may be provided with a trip free reset means.

BRIEF DESCRIPTION OF DRAWINGS

Turning now to FIGS. 1–3 of the drawings, numeral 10 is used to generally designate a conventional dual electrical outlet modified to incorporate the present invention. Receptacle 10 includes a cover 12 in which is defined first and second sets 14, 16 of female apertures adapted to accommodate conventional electrical attachment plugs, not shown. Bracket 18, best seen in FIG. 2 is a conventional bracket used to mount the receptacle in a box and includes blade connection means 20 for grounding the plug. FIG. 3 shows housing 22 formed of electrically insulative material comprising side walls 24 and bottom wall 26 and generally comprises spaced channels 28L and 28R intermediate a central channel 30. Channel 30 is defined by parallel wall members 32, 34. A first electrically conductive elongated rail member 36 is received in channel 28L and essentially is coextensive in length therewith and a second electrically conductive elongated rail member 38 is received in channel 28R and essentially is coextensive in length therewith, the rails being essentially mirror images of one another.

The rail members have upper and lower female blade connectors 36.1, 36.2 and 38.1, 38.2 respectively which are adapted to electrically engage male blade terminals of plugs in a conventional manner. As is conventional, rail members are also provided with upper and lower screw connector means 36.3, 36.4 and 38.3, 38.4 respectively and upper and lower back piercing means 36.5, 36.6 and 38.5, 38.6 respectively. The upper and lower portions of the rail members are separated by ribs 26.1, 26.2 which extend laterally across the respective channels 28L, 28R but are integrally connected by respective tab portions 36.7, 38.7 which are disposed above the ribs.

Figure 1:
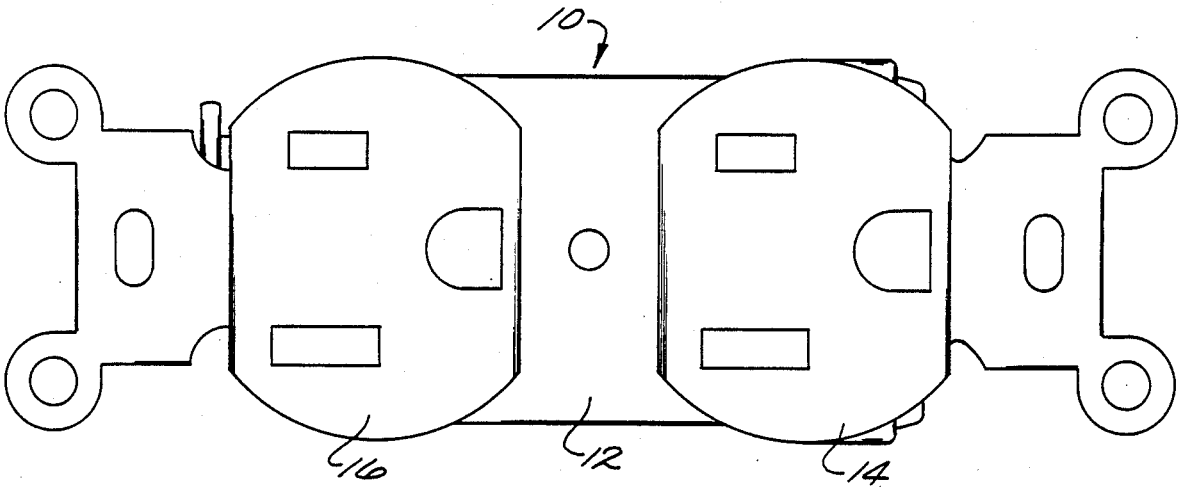
FIG. 1 is a front elevational view of a receptacle made in accordance with the invention.
Figure 2:
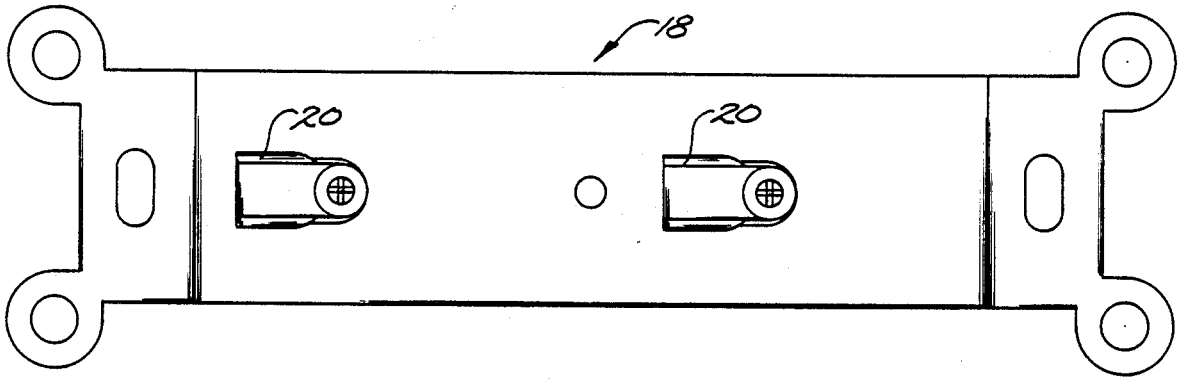
FIG. 2 is a front elevational view of the bracket used for mounting the receptacle in an outlet box.
Figure 3:
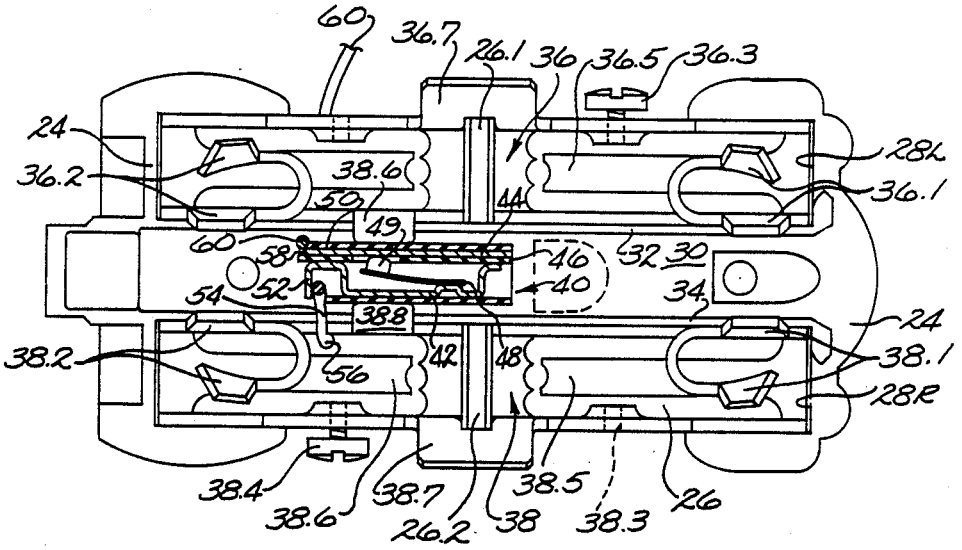
FIG. 3 is a front elevational view of the receptacle of claim 1 with the cover and bracket removed.

A thermally responsive switch 40 is mounted in the central channel 30 and comprises a thermally and electrically conductive can 42 having a bottom wall and side walls extending therefrom and an electrically and thermally conductive lid 44 received on the side walls and closing the switch with an electrically insulative layer 46 interposed between the can and the lid to electrically isolate one from the other. A thermally responsive element, preferably in the form of a bimetallic, snap acting disc 48 having first and second opposite distal end portions is cantilever mounted on the can at its first distal end portion and has a movable contact 49 mounted on its second distal end portion adapted to move into and out of electrical engagement with lid 44 through a window in insulative layer 46. In its normal, contacts engaged position disc 48 has an upwardly facing, concave configuration as shown in FIG. 3 and upon having its temperature increased to a first selected temperature will snap to an opposite, contacts disengaged position having an upwardly facing, convex configuration (not show). A heat shrinkable electrically insulative sleeve 50 of Mylar, a polyethylene terephthalate resin, or other suitable material circumscribes switch 40 and the entire switch assembly is placed in close thermal engagement with rail members 36, 38 as by physically engaging sleeve 50 with respective tab portions 36.8, 38.8 of rail members 36, 38 which may be bent to extend into central channel 30.

Switch 40 has a first terminal 52 extending from the can which is coupled in a conventional manner, as by soldering, to a lead 54 which in turn is connected to rail 38 as shown at 56. Switch 40 has a second terminal 58 extending from lid 44 which is coupled to lead 60 in a conventional manner. Lead 60 extends from lid 44 out through a suitable opening (not shown) in bottom wall 26 of the receptacle and is adapted for connection to an electrical supply such as the negative power supply. The other power supply is connected to rail 36 in a conventional manner, for example via screw connector 36.3.

A temperature of 130 degrees C. or greater within the cavity of the receptacle is indicative of some type of malfunction. For example, the malfunction could be caused by a loose connection of the supply to the rail member, a defective plug or cord, a short circuit or an overload. In order to avoid any deleterious effects of overheating not only to the receptacle but also to adjacent materials, it is preferred to interrupt power to the receptacle once the temperature within its cavity reaches a selected lower limit such as between approximately 70 to 90 degrees C.

Disc 48 is a bimetallic element formed with a dished configuration so that it will snap from one dished configuration to an opposite dished configuration upon reaching an increasing temperature of a preselected level known as the set temperature. It has been found that a preselected temperature level of approximately 90 degrees C. is effective to prevent deleterious effects of excessive temperature levels anywhere in the receptacle, including interconnecting points on the rail members and in the immediate environs.

Such discs are also formed so that they have a preselected reset temperature level. That is, once the disc snaps to the opposite dished configuration its temperature must be lowered to a certain temperature lower than the set temperature before it will snap back to its original dished configuration. In certain applications it may be preferred, upon the occurrence of a switch tripping due to an overtemperature condition, to ensure that a skilled artisan inspect the receptacle installation prior to permitting re-energization of the receptacle. In this case disc 48 is chosen to have a reset temperature of low value, for example −20 degrees C. This would necessitate removal of the receptacle and cooling it to that temperature before the disc will automatically reset thereby giving the person removing the receptacle an opportunity to inspect the condition of the various connections.

Figure 4:
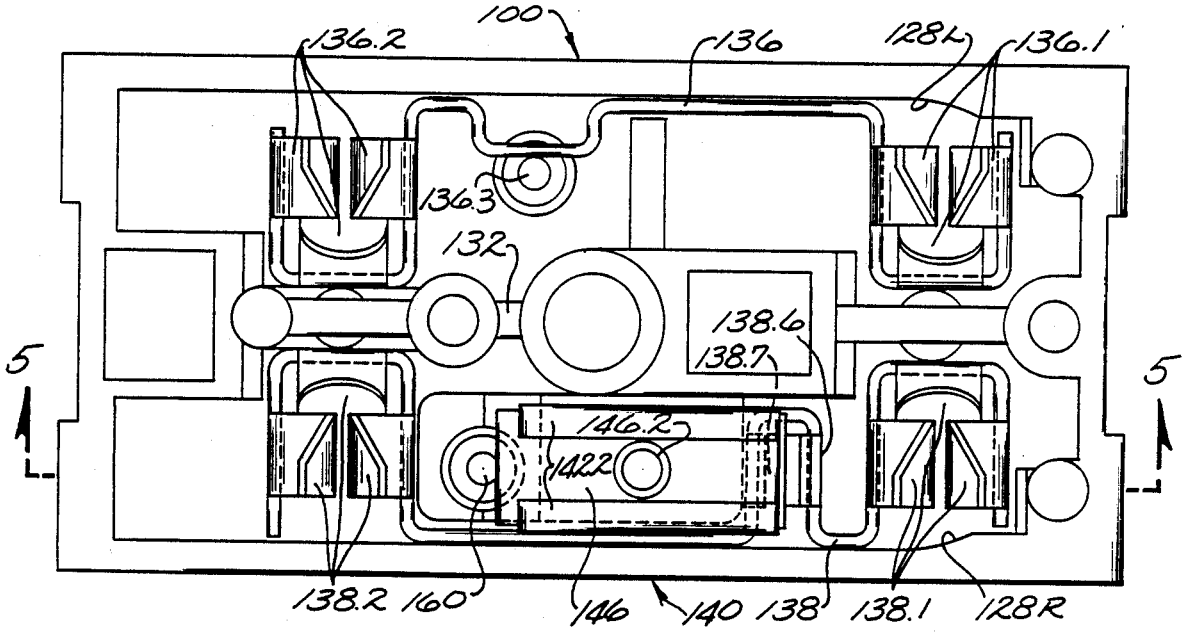
FIG. 4 is a front elevational view of a second embodiment of the invention showing a receptacle with the front cover and bracket removed.
Figure 5:
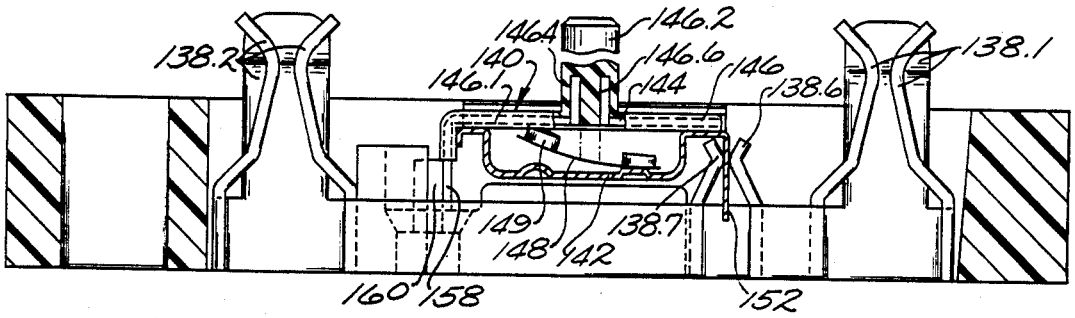
FIG. 5 is a cross sectional view taken through line 5—5 of FIG. 4.

On the other hand, in many other applications it may be preferred to provide a manual reset means so that once the disc has had a chance to cool off to a normal ambient temperature application of a selected force to the disc will cause it to snap back to its original configuration. With particular reference to FIGS. 4 and 5 a switch having a manual reset means will be described.

Terminal housing 100 is shown having a slightly different internal configuration relative to housing 22 in FIG. 3. Housing 100 is shown with channels 128L and 128R separated by a central rib 132. First and second electrically conductive rail members 136 and 138 are disposed in respective channels 128L and 128R. Thermally responsive switch 140 comprises a thermally and electrically conductive can 142 adjacent to and in close thermal coupling with rail 138. Terminal 152 extending from can 142 is electrically connected to rail 138 as shown at 138.6 and 138.7. Switch 140 is provided with electrically conductive lid 144 which is received over and closes can 142 with a layer 146 of electrically insulative material interposed therebetween to electrically separate the can and the lid. As seen in FIG. 4, can 142 is provided with flanges 142.2 on opposite sides of the open end which are bent over to clampingly engage layer 146 and lid 144. Layer 146 is formed with a flexible button portion 146.2 which extends outwardly from the switch through an aperture formed in lid 144. Button 146.2 is joined to layer 146.2 by sleeve portion 146.4 and has a core portion 146.6 which essentially coextends with sleeve portion 146.6 and is movable into the cavity of the switch as shown in dashed lines in FIG. 5.

A snap acting disc 148 has a first distal end cantilever mounted to can 142 and has a second free distal end provided with a movable contact 149 adapted to move into and out of engagement with lid 144 through a window 146.1 in layer 146.

Disc 148 is formed so that in its normal at rest position it has a concave configuration facing lid 144 with movable contact 149 mounted on the face of the disc facing lid 144. Upon having its temperature increased to a selected level, e.g. 70 degrees C. the disc will snap to an opposite convex configuration facing lid 149 with the movable contact moving away from lid 144. When this occurs power to the receptacle is interrupted. It will be seen that depression of reset button 146.2 tends to move disc 148 away from lid 144 so that if the temperature is too high the safety switch cannot be overridden by the reset means thereby providing a trip free reset feature. Once the disc has cooled to or below a selected reset temperature, e.g. 40 degrees C. button 146.2 can be depressed with core 146.6 engaging the convex shaped disc with a force applied thereto causing the disc to snap back to its concave configuration facing lid 144 with movable contact 149 coming into electrical contact with lid 144 once the reset button is allowed to return to its rest position.

Lid 144 has a terminal 158 extending therefrom which is connected to a lead 160 as by soldering which lead extends through an aperture in the back wall of the receptacle for connection to a power supply, the other side of the power supply being connected to rail 136 as shown at 136.3 which shows a lead connected as by soldering to rail 136.

Figure 6:
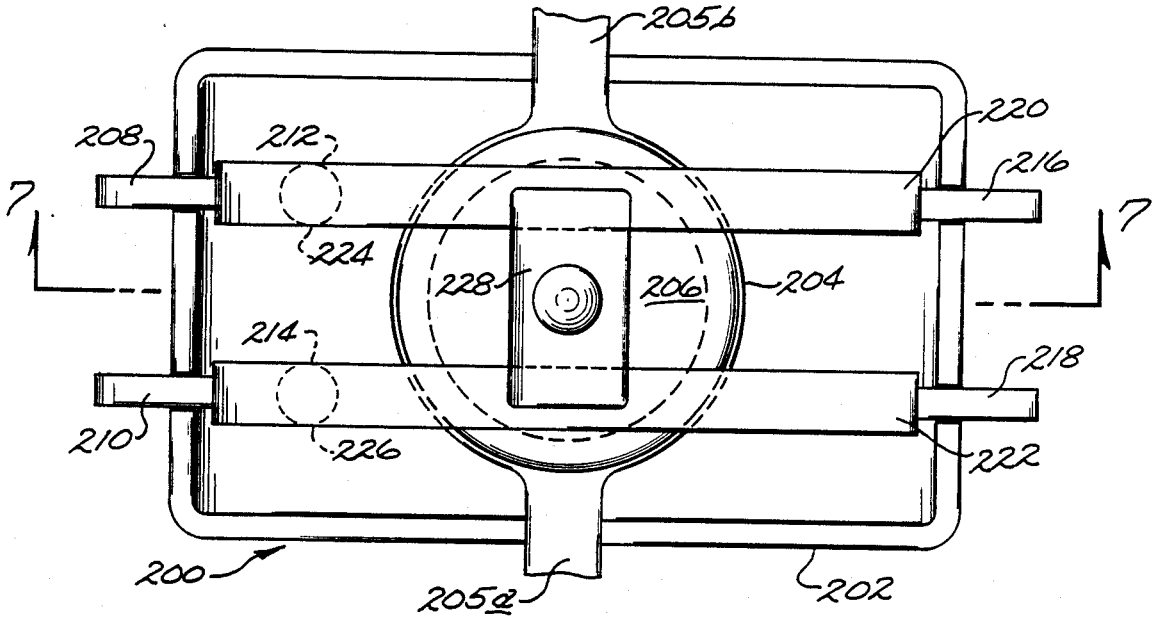
FIG. 6 is a top plan view of a thermally responsive switch according to a third embodiment of the invention shown without the top cover.
Figure 7:
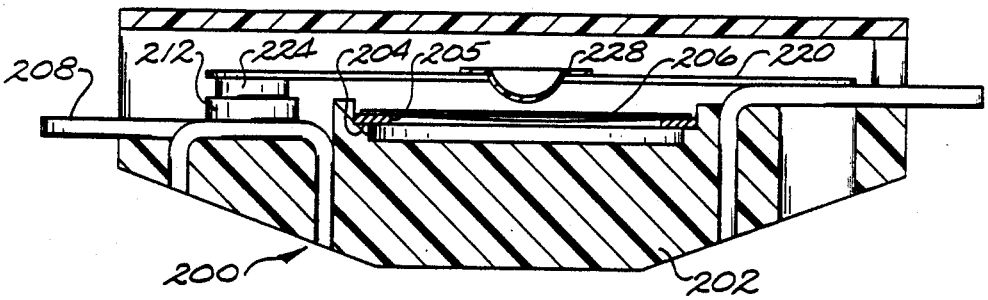
FIG. 7 is a cross sectional view taken along line 7—7 of FIG. 6 but shown including the cover.

With reference to FIGS. 6 and 7 a thermally responsive switch is shown which can be used to electrically interrupt both rail members. Switch 200 is a double pole switch adapted to be received within the receptacle cavity and includes a base 202 formed of electrically insulative material in which is formed a seat 204 for a thermally responsive member, such as a bimetallic snap acting disc 206. As shown in the drawing a heat conductive bridge 205, if desired, can be placed on seat 204 with disc 206 received thereon in optimum heat transfer relation. Bridge 206 can be an annular configuration with arms 205*a* and *b* extending laterally therefrom for placement in optimum heat transfer relation with the rail members, for example by physically engaging rail members 136, 138 of FIG. 4 with suitable interposing electrical insulation in order to provide enhanced thermal response of the switch. Base 202 mounts first and second line terminals 208, 210 on which are mounted in a conventional manner, respective stationary electrical contacts 212, 214. Load terminals 216, 218 are mounted on base 202 on an opposite end thereof and respectively mount in cantilever fashion, as by welding or the like, conductive movable contact arms 220, 222. Movable electrical contacts 224, 226 are respectively mounted in a conventional manner on the free distal end of movable contact arms 220, 222 and are arranged to move into and out of engagement with respective stationary contacts 212, 214. An electrically insulating bridge member 228 is fixedly attached, as by ultra sonic bonding, to movable contact arms 220, 222. Thus when disc 206 snaps to its opposite dished configuration upon selected temperature conditions, that is from the upwardly facing concave configuration shown in FIG. 7 to an upwardly facing convex configuration, not shown, the disc will push bridge 228 upwardly thereby causing the movable arms 220, 222 to move upwardly and the movable contacts 224, 226 to move out of engagement with stationary contacts 212, 214. Terminals 216, 218 are connected to first and second rail members of the receptacle and thus both have their electrical continuity broken upon actuation of the thermally responsive switch 200. A particular advantage of this embodiment for certain applications is that the thermally responsive element, disc 206, does not carry current and therefore can be used exclusively to sense ambient temperature conditions without having any $I^2R$ heating in the disc member.

It is within the purview of the invention to use other temperature responsive switches which can be adapted to the space limitations of the receptacle to be protected.

Figure 8:
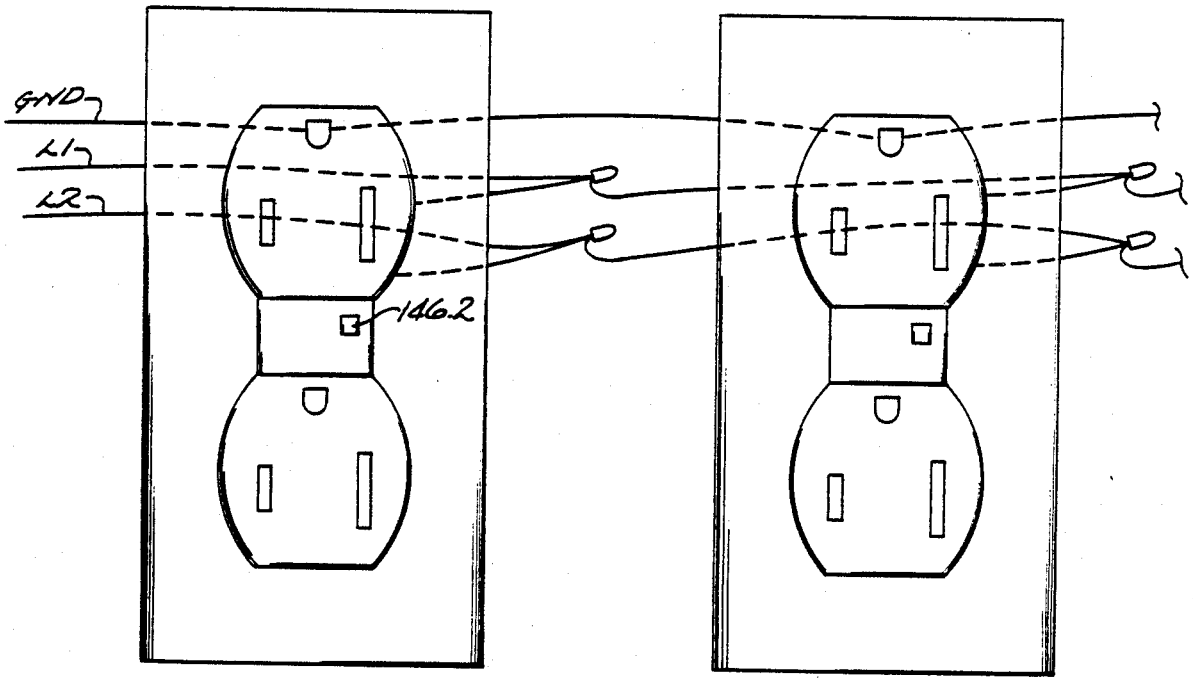
FIG. 8 is a schematic representation of receptacles wired in a so called daisy chain configuration.

In addition to being effective for the various fire hazards referred to above, particularly with respect to a receptacle in use, the invention advantageously protects a daisy chain type of installation including outlets which are not being used or even outlets which have never been used. That is, it is common to wire a receptacle to bring the supply connections L1, L2 in FIG. 8 from the fuse or circuit breaker branch circuit protecting device (not shown) to a first duplex receptacle and then extend the source of supply from other terminals provided on that receptacle to an additional receptacle and in turn extend from one outlet to another in this daisy chain manner. By means of the invention all protected outlets are protected including outlets which may never have been used but which could be overheating due to the loosening of feed-through supply connections serving an outlet further down the chain. Such an outlet could otherwise lead to the origination of a fire at a location not even suspected by the user.

Having described several preferred embodiments of the invention, it is understood that various changes and modifications can be made without departing from the spirit of the invention, and it is desired to cover by the appended claims all such changes and modifications which come within the spirit and scope of the invention.

We claim:

1. Electrical outlet receptacle apparatus comprising:

a housing having a front wall portion in which is defined at least one set of apertures adapted to receive male components of an electrical plug, the housing also having side and rear walls defining a cavity therein, first and second electrically conductive rail members mounted in the housing within the cavity in alignment with respective first and second apertures of the at least one set of apertures, means for disconnecting a power supply upon selected increase in temperature of either of the rail members comprising a switch disposed in the cavity in heat transfer relation with both the first and the second rail members, the thermally responsive switch having a stationary and a movable electrical contact, a thermostatic snap acting disc operatively connected to the movable contact movable between one dished configuration and an opposite dished configuration at preselected temperature conditions, the element being adapted to move the movable electrical contact into and out of engagement with the stationary contact, the movable contact normally being in engagement with the stationary contact, the switch having first and second terminals, one terminal electrically connected to one of the rail members, the other terminal connected to a first electrical connection means extending through the housing and adapted to be connected to one side of an electrical supply, a second electrical connection means connected to the other rail member and extending through the housing for connection to the other side of the electrical supply.

2. Electrical outlet receptacle apparatus comprising:

a housing having a front wall portion in which is defined at least one set of apertures adapted to receive male components of an electrical plug, the housing also having side and rear walls defining a cavity therein, first and second electrically conductive rail members mounted in the housing within the cavity in alignment with respective first and second apertures of the at least one set of apertures, a thermally responsive switch having a stationary and a movable electrical contact, a thermostatic snap acting disc operatively connected to the movable contact movable between one dished configuration and an opposite dished configuration at preselected temperature conditions, the element being adapted to move the movable electrical contact into and out of engagement with the stationary contact, the movable contact normally being in engagement with the stationary contact, the switch being disposed in the cavity in heat transfer relation with the first and second rail members, the switch having first and second terminals, one terminal electrically connected to one of the rail members, the other terminal connected to a first electrical connection means extending through the housing and adapted to be connected to one side of an electrical supply, a second electrical connection means connected to the other rail member and extending through the housing for connection to the other side of the electrical supply, the switch comprising an electrically and thermally conductive can having a bottom wall and side walls extending therefrom, the disc having first and second distal end portions, the first distal end portion being cantilever mounted on the bottom wall of the can, an electrically and thermally conductive lid received over the walls and closing the can, and electrically insulative material electrically separating the lid from the can, the movable electrical contact mounted on the second distal end of the disc and adapted to move into and out of electrical engagement with the lid at said preselected temperature conditions.

3. Electrical outlet receptacle apparatus comprising:

a housing having a front wall portion in which is defined at least one set of apertures adapted to receive male components of an electrical plug, the housing also having side and rear walls defining a cavity therein, first and second electrically conductive rail members mounted in the housing within the cavity in alignment with respective first and second apertures of the at least one set of apertures, a thermally responsive switch having a stationary and a movable electrical contact, a thermostatic snap acting disc operatively connected to the movable contact movable between one dished configuration and an opposite dished configuration at preselected temperature conditions, the element being adapted to move the movable electrical contact into and out of engagement with the stationary contact, the movable contact normally being in engagement with the stationary contact, the switch being disposed in the cavity in heat transfer relation with the first and second rail members, a layer of electrically insulative material circumscribing the switch, the switch having first and second terminals, one terminal electrically connected to one of the rail members, the other terminal connected to a first electrical connection means extending through the housing and adapted to be connected to one side of an electrical supply, a second electrical connection means connected to the other rail member and extending through the housing for connection to the other side of the electrical supply.

4. Electrical outlet receptacle apparatus according to claim 3 in which the insulative material is a heat shrinkable sleeve.

5. Electrical outlet receptacle apparatus according to claim 3 in which the first and second electrically conductive rail members each have a tab portion bent inwardly into the cavity, the layer of electrically insulating material being biased against said tab portion in optimum heat conductive relation therewith.

6. Electrical outlet receptacle apparatus according to claim 1 in which the disc is chosen to snap from a configuration in which the movable contact is in engagement with the stationary contact to its opposite configuration when its temperature increases to approximately 90 degrees C.

7. Electrical outlet receptacle apparatus according to claim 6 in which the disc, once it snaps to its opposite configuration, is selected to snap back to its contacts engaged configuration when it is cooled down to approximately minus 20 degrees C.

8. Electrical outlet receptacle apparatus comprising:

a housing having a front wall portion in which is defined at least one set of apertures adapted to receive male components of an electrical plug, the housing also having side and rear walls defining a cavity therein, first and second electrically conductive rail members mounted in the housing within the cavity in alignment with respective first and second apertures of the at least one set of aperture, a thermally responsive switch having a stationary and a movable electrical contact, a thermostatic snap acting disc operatively connected to the movable contact movable between one dished configuration and an opposite dished configuration at preselected temperature conditions, the element being adapted to move the movable electrical contact into and out of engagement with the stationary contact, the movable contact normally being in engagement with the stationary contact, the switch being provided with trip free manual reset means comprising a depressible button member mounted on the receptacle apparatus and adapted upon depression to cause the disc to move from its contacts disengaged configuration to its contacts engaged configuration when the disc decreases its temperature to a selected reset temperature, the switch being disposed in the cavity in heat transfer relation with the first and second rail members, the switch having first and second terminals, one terminal electrically connected to one of the rail members, the other terminal connected to a first electrical connection means extending through the housing and adapted to be connected to one side of an electrical supply, a second electrical connection means connected to the other rail member and extending through the housing for connection to the other side of the electrical supply.

9. Electrical outlet receptacle apparatus according to claim 8 in which the switch comprises a housing, the snap acting disc disposed in the housing having a contacts engaged, upwardly facing concave configuration, and being movable upon selected temperature conditions to a contacts disengaged, upwardly facing convex configuration, an elongated member mounted on a wall of the housing and extending away from the housing, the elongated member aligned with the snap acting disc and having a lower surface portion movable into engagement with the snap acting disc upon selected depression movement of the elongated member, the elongated member adapted to apply a force to the snap acting disc to cause it to move from its upwardly facing convex configuration to its upwardly facing concave configuration.

10. Electrical outlet receptacle apparatus according to claim 9 in which a stationary contact is mounted on a top wall of the housing, the snap acting disc having first and second opposite end portions, the first end portion mounted on a bottom wall of the housing, the movable contact mounted on the second end portion on the upwardly facing surface such that the elongated member, when depressed to apply a force to the disc, applies the said force in a direction to move the movable contact away from the stationary contact.

11. Electrical outlet receptacle apparatus according to claim 1 in which the switch is a two pole switch, one pole adapted to interrupt power in said one of the rail members and the other pole adapted to interrupt power in the other rail member.

12. Electrical outlet receptacle apparatus comprising:

a housing having a front wall portion in which is defined at least one set of apertures adapted to receive male components of an electrical plug, the housing also having side and rear walls defining a cavity therein, first and second electrically conductive rail members mounted in the housing within the cavity in alignment with respective first and second apertures of the at least one set of apertures, a thermally responsive switch having a stationary and a movable electrical contact, a thermostatic snap acting disc operatively connected to the movable contact movable between one dished configuration and an opposite dished configuration at preselected temperature conditions, the element being adapted to move the movable electrical contact into and out of engagement with the stationary contact, the movable contact normally being in engagement with the stationary contact, the switch being disposed in the cavity in heat transfer relation with the first and second rail members, the switch having first and second terminals, one terminal connected to one of the rail members, the other terminal connected to a first electrical connection means extending through the housing and adapted to be connected to one side of an electrical supply, a second electrical connection means connected to the other rail member and extending through the housing for connection to the other side of the electrical supply, the switch comprising an electrically and thermally conductive can having a bottom wall and side walls extending therefrom, the disc having first and second distal end portions, the first distal end portion being mounting on the bottom wall of the can, an electrically and thermally conductive lid received over the walls and closing the can, and electrically insulative material electrically separating the lid from the can, the movable electrical contact mounted on the second distal end of the disc and adapted to move into and out of electrical engagement with the lid at said preselected temperature conditions, the can disposed in the housing cavity in physical engagement with said one of the rail members.

13. Electrical outlet receptacle apparatus according to claim 1 in which the switch is disposed in the housing cavity in physical engagement with said one of the rail members.

14. Electrical outlet apparatus receptacle comprising:

A housing having a front wall portion in which is defined at least one set of apertures adapted to receive male components of an electrical plug, the housing also having side and rear walls defining a cavity therein, first and second electrically conductive rail members mounted in the housing within the cavity in alignment with respective first and second apertures of the at least one set of apertures, means for disconnecting a power supply upon selected increase in temperature of either of the rail members comprising a thermally responsive switch disposed in the cavity in heat transfer relation with both the first and the second rail members, the thermally responsive switch having a stationary and a movable electrical contact, a thermostatic element operatively connected to the movable contact movable between first and second configurations at preselected temperature conditions, the element being adapted to move the movable electrical contact into and out of engagement with the stationary contact in one of said first and second configurations, the movable contact normally being in engagement with the stationary contact, the switch having first and second terminals, one terminal electrically connected to one of the rail members, the other terminal connected to a first electrical connection means extending through the housing and adapted to be connected to one side of an electrical supply, a second electrical connection means connected to the other rail member and extending through the housing for connection to the other side of the electrical supply.

15. Electrical outlet receptacle apparatus comprising:

A housing having a front wall portion in which is defined at least one set of apertures adapted to receive male components of an electrical plug, the housing having side and rear walls defining a cavity therein, first and second electrically conductive rail members mounted in the housing within the cavity in alignment with respective first and second apertures of the at least one set of apertures, means for disconnecting a power supply upon selected increase in temperature of either of the rail members comprising a thermally responsive switch disposed in the cavity in heat transfer relation with both the first and the second rail members, the thermally responsive switch having a stationary and a movable electrical contact, a thermostatic element operatively connected to the movable contact adapted to move the movable electrical contact into and out of engagement with the stationary contact upon selected temperature conditions, the movable contact normally being in engagement with the stationary contact, the contacts of the switch being electrically coupled between at least one of the conductive rail members and an electrical power supply so that power to the rail members is interrupted upon the occurrence of preselected temperature conditions.

16. Electrical outlet receptacle apparatus comprising:

a housing having a front wall portion in which is defined at least one set of apertures adapted to receive male components of an electrical plug, the housing having side and rear walls defining a cavity therein, first and second electrically conductive rail members mounted in the housing within the cavity in alignment with respective first and second apertures of the at least one set of apertures, means for disconnecting a power supply upon selected increase in temperature of either of the rail members comprising a thermally responsive switch disposed in the cavity in heat transfer relation with both the first and the second rail members, the thermally responsive switch having a stationary and a movable electrical contact, a thermostatic snap acting element operatively connected to the movable contact movable between one dished configuration and an opposite dished configuration at preselected temperature conditions, the element being adapted to move the movable electrical contact into and out of engagement with the stationary contact, the movable contact normally being in engagement with the stationary contact, the contacts of the switch being electrically coupled between at least one of the conductive rail members and an electrical power supply so that power to the rail members is interrupted upon the occurrence of preselected temperature conditions.

17. Electrical outlet receptacle apparatus comprising:

a housing having a front wall portion in which is defined at least one set of apertures adapted to receive male components of an electrical plug, the housing having side and rear walls defining a cavity therein, first and second electrically conductive rail members mounted in the housing within the cavity in alignment with respective first and second apertures of the at least one set of apertures, a thermally responsive switch having a stationary and a movable electrical contact, a thermostatic snap acting element operatively connected to the movable contact movable between one dished configuration and an opposite dished configuration at preselected temperature conditions, the element being adapted to move the movable electrical contact into and out of engagement with the stationary contact, the movable contact normally being in engagement with the stationary contact, the switch being disposed in the cavity in heat transfer relation with the first and second rail members, the contacts of the switch being electrically coupled between at least one of the conductive rail members and an electrical power supply so that power to the rail members is interrupted upon the occurrence of preselected temperature conditions and trip free manual reset means comprising a depressible button member mounted on the receptacle apparatus and adapted upon depression to cause the disc to move from its contacts disengaged configuration to its contacts engaged configuration when the disc decreases its temperature to a selected reset temperature.

18. Electrical outlet receptacle apparatus according to claim 17 in which the switch comprises a housing, the snap acting disc disposed in the housing having a contacts engaged, upwardly facing concave configuration, and being movable upon selected temperature conditions to a contacts disengaged, upwardly facing convex configuration, an elongated member mounted on a wall of the housing and extending away from the housing, the elongated member aligned with the snap acting disc and having a lower surface portion movable into engagement with the snap acting disc upon selected depression movement of the elongated member, the elongated member adapted to apply a force to the snap acting disc to cause it to move from its upwardly facing convex configuration to its upwardly facing concave configuration.

19. Electrical outlet receptacle apparatus according to claim 17 in which a stationary contact is mounted on a top wall of the housing, the snap acting disc having first and second opposite end portions, the first end portion mounted on a bottom wall of the housing, the movable contact mounted on the second end portion on the upwardly facing surface such that the elongated member, when depressed to apply a force to the disc, applies the said force in a direction to move the movable contact away from the stationary contact.

20. Electrical outlet receptacle apparatus according to claim 15 in which the switch is a two pole switch, one pole adapted to interrupt power in said one of the rail members and the other pole adapted to interrupt power in the other rail member.

21. Electrical outlet receptacle apparatus according to claim 16 in which the switch is a two pole switch, one pole adapted to interrupt power in said one of the rail members and the other pole adapted to interrupt power in the other rail member.

22. Electrical outlet receptacle apparatus comprising:

a housing having a front wall portion in which is defined at least one set of apertures adapted to receive male components of an electrical plug, the housing having side and rear walls defining a cavity therein, first and second electrically conductive rail members mounted in the housing within the cavity in alignment with respective first and second apertures of the at least one set of apertures, a thermally responsive switch having a stationary and a movable electrical contact, a thermostatic snap acting element operatively connected to the movable contact movable between one dished configuration and an opposite dished configuration at preselected temperature conditions, the element being adapted to move the movable electrical contact into and out of engagement with the stationary contact, the movable contact normally being in engagement with the stationary contact, the switch being disposed in the cavity in heat transfer relation with the first and second rail members, the contacts of the switch being electrically coupled between at least one of the conductive rail members and an electrical power supply so that power to the rail members is interrupted upon the occurrence of preselected temperature conditions, the switch comprising an electrically and thermally conductive can having a bottom wall and side walls extending therefrom, the disc having first and second distal end portions, the first distal end portion being mounted on the bottom wall of the can, an electrically and thermally conductive lid received over the walls and closing the can, and electrically insulative material electrically separating the lid from the can, the movable electrical contact mounted on the second distal end of the disc and adapted to move into and out of electrical engagement with the lid at said preselected temperature conditions, the can disposed in the housing cavity in physical engagement with said one of the rail members.

23. Electrical outlet receptacle apparatus according to claim 16 in which the disc is chosen to snap from a configuration in which the movable contact is in engagement with the stationary contact to its opposite configuration when its temperature increases to approximately 90 degrees C.

24. Electrical outlet receptacle apparatus according to claim 23 in which the disc, once it snaps to its opposite configuration, is selected to snap back to its contacts engaged configuration when it is cooled down to approximately minus 20 degrees C.

25. Electrical outlet receptacle apparatus according to claim 17 in which the disc is chosen to snap from a configuration in which the movable contact is in engagement with the stationary contact to its opposite configuration when its temperature increases to approximately 90 degrees C.

26. Electrical outlet receptacle apparatus according to claim 25 in which the disc, once it snaps to its opposite configuration, is selected to snap back to its contacts engaged configuration when it is cooled down to approximately minus 20 degrees C.

27. Electrical outlet receptacle apparatus according to claim 15 in which the switch is disposed in the housing cavity in physical engagement with said one of the rail members.

28. Electrical outlet receptacle apparatus according to claim 16 in which the switch is disposed in the housing cavity in physical engagement with said one of the rail members.

29. Electrical outlet receptacle apparatus according to claim 17 in which the switch is disposed in the housing cavity in physical engagement with said one of the rail members.

30. Electrical outlet receptacle apparatus according to claim 11 in which the disc is in engagement with a heat conductive member which extends from the switch for placement in optimum heat conductive relation with the rail members.

31. Electrical outlet receptacle apparatus according to claim 15 in which the thermostatic element is in engagement with a heat conductive member which extends from the switch for placement in optimum heat conductive relation with the rail members.

32. Electrical outlet apparatus receptacle comprising:

A housing having a front wall portion in which is defined at least one set of apertures adapted to receive male components of an electrical plug, the housing also having side and rear walls defining a cavity therein, first and second electrically conductive rail members mounted in the housing within the cavity in alignment with respective first and second apertures of the at least one set of apertures, means for disconnecting a power supply upon selected increase in temperature of either rail members comprising a heat responsive member disposed in the cavity in heat transfer relation with both the first and the second rail members, the heat responsive member coupled to first and second terminals, one terminal electrically connected to one of the rail members, the other terminal connected to a first electrical connection means extending through the housing and adapted to be connected to one side of an electrical supply, a second electrical connection means connected to the other rail member and extending through the housing for connection to the other side of the electrical supply.

* * * * *